US006520362B2

(12) United States Patent
Heisel et al.

(10) Patent No.: US 6,520,362 B2
(45) Date of Patent: Feb. 18, 2003

(54) RETORTABLE PLASTIC CONTAINER

(75) Inventors: Timothy Heisel, Bartlett, IL (US); Annette Stasiak, Naperville, IL (US); Christopher Farrell, Arlington Heights, IL (US)

(73) Assignee: Consolidated Container Company, LLC, Atlanta, GA (US)

( * ) Notice: Subject to any disclaimer, the term of this patent is extended or adjusted under 35 U.S.C. 154(b) by 0 days.

(21) Appl. No.: 09/809,960

(22) Filed: Mar. 16, 2001

(65) Prior Publication Data

US 2002/0158038 A1 Oct. 31, 2002

(51) Int. Cl.[7] ..... B65D 1/02; B65D 1/40; B65D 23/00

(52) U.S. Cl. ..... 215/381; 215/383; 215/12.1; 220/669; 220/675

(58) Field of Search ..... 215/375, 381, 215/373; 220/606, 609, 669, 675

(56) References Cited

U.S. PATENT DOCUMENTS 4,451,512 A * 5/1984 Yazaki et al. ..... 215/373 X
4,880,129 A * 11/1989 McHenry et al. ..... 220/606 X
5,123,554 A * 6/1992 Arvidson et al. ..... 215/382 X
5,217,737 A 6/1993 Gygax ..... 426/111
5,234,126 A 8/1993 Jones et al. ..... 220/609
5,269,437 A 12/1993 Gygax ..... 220/606
5,908,128 A * 6/1999 Krishnakumar et al. .... 215/381

* cited by examiner

*Primary Examiner*—Sue A. Weaver
(74) *Attorney, Agent, or Firm*—Sonnenschein, Nath Rosenthal

(57) ABSTRACT

A retortable plastic container with a side wall having at least one flexing portion extending from a top horizontal line around a circumference of the side wall to a bottom horizontal line around the circumference of the side wall. The flexing portion has an inwardly directed surface relative to the circumference of the side wall. The inwardly directed surface has a first length measured along the inwardly directed surface, in a central vertical plane from the top horizontal line to the bottom horizontal line, which is greater than a straight line distance between the top and bottom horizontal lines in the same vertical plane. The inwardly directed surface also has a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

39 Claims, 8 Drawing Sheets

FIG.3
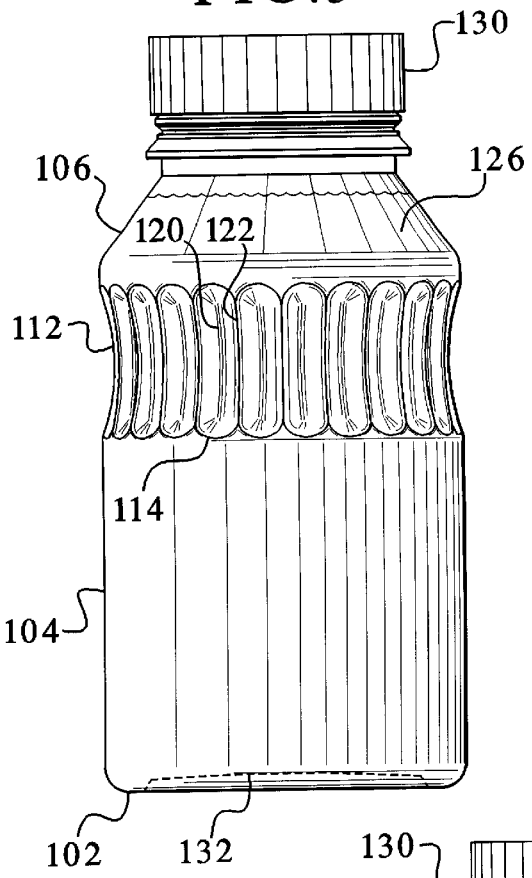
FIG.4
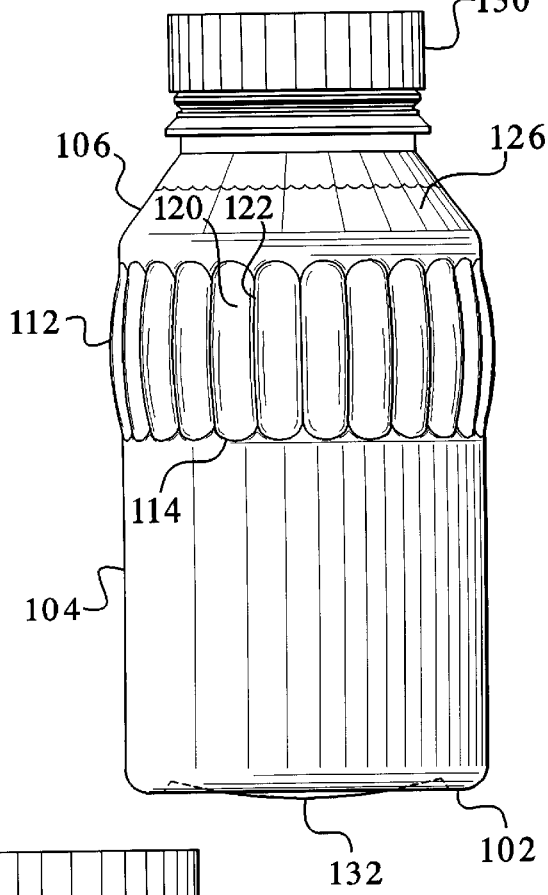
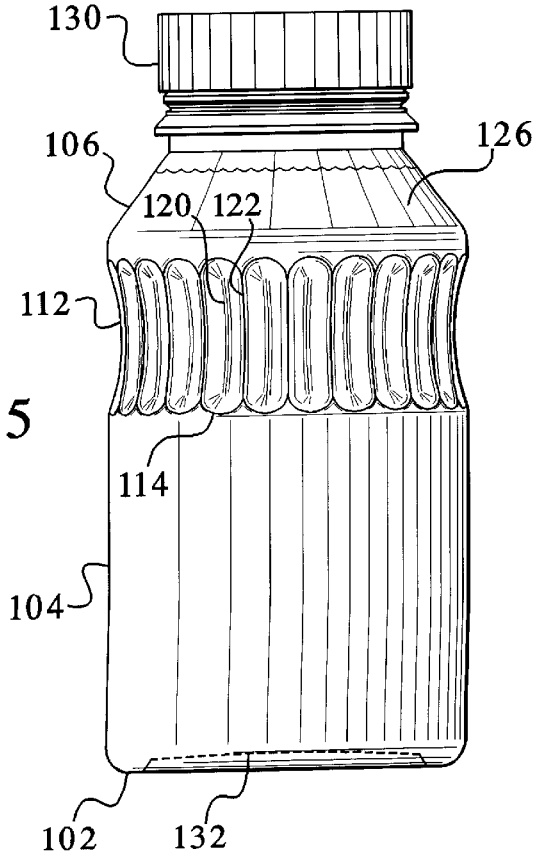
FIG.5

RETORTABLE PLASTIC CONTAINER

BACKGROUND OF THE INVENTION

The present invention generally relates to plastic containers. The present invention also relates to retortable containers.

As is known, containers and their contents are commonly subjected to retort conditions for sterilization. However, during a retort process, when a plastic container is subjected to relatively high temperatures and pressures, the plastic container's shape will distort. Upon cooling, the plastic container generally retains this distorted shape or at least fails to return to its pre-retort shape. In a worst case, the plastic container experiences a catastrophic failure, resulting in a collapse or a "blow out" of a portion of the plastic container.

One solution to overcoming these known disadvantages may be to provide a plastic container having very thick walls. The thicker walls might assist in resisting the high internal pressure generated within the plastic container. While this solution might resist some internal pressure, it often does not provide enough resistance to provide for higher value internal pressures. Thus, the plastic container often still experiences catastrophic failures under this proposed solution. Further, the increased wall thickness unfavorably increases the cost of the plastic container.

Another solution to overcoming the known disadvantages is to provide a plastic container having a flexible bottom portion. The flexible bottom portion of the proposed plastic container expands to accommodate the increased internal pressure of the plastic container. This solution is described in U.S. Pat. No. 5,217,737.

Accordingly, there is a need to provide a retortable plastic container that has a minimum weight and that has a flexibility to substantially return to its original shape after being subjected to a retort process.

SUMMARY OF THE INVENTION

The present disclosure provides one or more inventions directed to improvements in retortable plastic containers. These improvements can be practiced jointly or separately.

To this end, in an embodiment, there is provided a retortable plastic container, comprising a side wall having at least one flexing portion extending from a top horizontal line around a circumference of the side wall to a bottom horizontal line around the circumference of the side wall. The flexing portion has an inwardly directed surface relative to the circumference of the side wall. The inwardly directed surface has a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

In an embodiment, the inwardly directed surface includes a plurality of inwardly recessed indentations.

In another embodiment, the inwardly directed surface includes a plurality of ribs. The ribs each comprise a recessed portion being recessed toward an interior of the plastic container. The recessed portion resiliently flexes in a direction of an exterior of the container during retort. The ribs can be substantially aligned in the direction of the height of the container or a direction skewed to the direction of the height of the container.

In an embodiment, the inwardly directed surface includes a plurality of inwardly recessed dimples.

In an embodiment, the inwardly directed surface includes an array of connected geometric shapes.

In an embodiment, the side wall further has a plurality of flexing portions each at a different position along the height of the plastic container.

In an embodiment, the retortable plastic container further has a bottom portion, wherein at least a region of the bottom portion can resiliently flex in a direction of an exterior of the plastic container during retort. Alternatively, the bottom portion can have a sufficient thickness to not flex during retort. As discussed below, the bottom portion of the plastic container does not need to flex in order for the plastic container to assume a merchantable shape after a retort process.

In an embodiment, the side wall has a thickened portion proximate the flexing portion, the thickened portion having a thickness greater than a thickness of regions of the side wall adjacent the thickened portion.

In an embodiment, the side wall has an inwardly depressed groove formed therein about at least a part of the circumference of the side wall.

In an embodiment, the plastic container comprises polypropylene. In another embodiment, the plastic container comprises multi-layered polypropylene.

The plastic container can be used with a variety of products, such as, for example, aqueous products and/or comestibles.

There is also provided, in an embodiment, a retortable plastic container, comprising first and second longitudinal ends; a wall extending between the ends and surrounding a longitudinal axis; and flexible wall members positioned about a circumference of the wall, the flexible wall members being concavities in the wall and being effective to flex outwardly from the plastic container during retort in response to increased internal plastic container pressure and to return to a merchantable shape upon cessation of retort in response to decreased internal plastic container pressure.

There is also provided, in an embodiment, a method of forming a retortable plastic container, the method comprising forming a side wall having at least one flexing portion extending from a top horizontal line around a circumference of the side wall to a bottom horizontal line around the circumference of the side wall, the flexing portion having an inwardly directed surface relative to the circumference of the side wall, the inwardly directed surface having a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

In an embodiment, the side wall is formed with a plurality of flexing portions each at a different position along the height of the plastic container.

In an embodiment, a bottom portion of the plastic container is formed. At least a region of the bottom portion resiliently flexes in a direction of an exterior of the container during retort.

In an embodiment, the side wall is formed with a thickened portion proximate the flexing portion, the thickened portion having a thickness greater than a thickness of regions of the side wall adjacent the thickened portion.

In an embodiment, the side wall is formed with an inwardly depressed groove therein about at least a part of the circumference of the side wall.

There is further provided, in an embodiment, a method of reducing differential pressure on a plastic container during retort, the method comprising: providing a side wall of the plastic container, the side wall having at least one flexing portion extending from a top horizontal line around a circumference of the side wall to a bottom horizontal line around the circumference of the side wall, the flexing portion having an inwardly directed surface relative to the circumference of the side wall, the inwardly directed surface having: a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

These and other features of the present invention will become clearer with reference to the following detailed description of the presently preferred embodiments and accompanying drawings.

DESCRIPTION OF THE DRAWINGS

FIG. 3 is a front view of the retortable plastic container of FIG. 1 having a closure and filled with a product prior to a retort process.

FIG. 4 is a front view of the retortable plastic container of FIG. 1 during the retort process.

FIG. 5 is a front view of the retortable plastic container of FIG. 1 after the retort process.

DETAILED DESCRIPTION OF THE PRESENTLY PREFERRED EMBODIMENTS

As discussed above, there is provided a plastic container capable of returning to a merchantable shape after a retort process.

Figure 1:
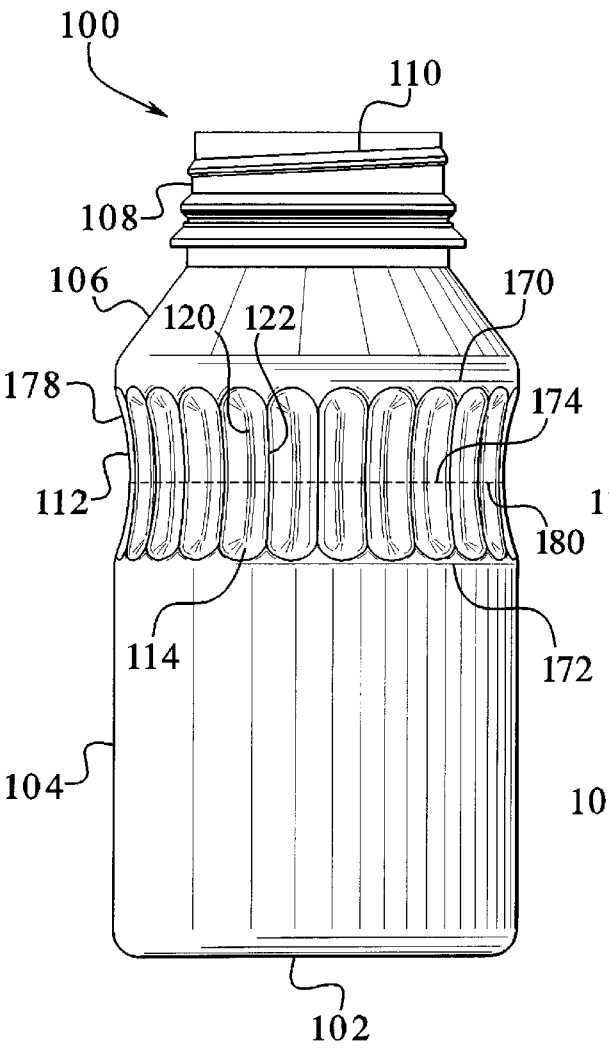
FIG. 1 is a front view of a retortable plastic container embodying principles of the present invention.

In FIG. 1, there is illustrated a retortable plastic container 100 that embodies principles of the present invention. As illustrated, the plastic container 100 has a bottom portion 102, a side wall 104 having a shoulder 106 and a neck 108.

An opening in the neck 108 of the plastic container 100 can be closed by any suitable structure. For example, as illustrated, the neck 108 can have threads 110 for engaging a closure 130. Alternatively, the neck 108 can comprise any other suitable structure capable of engaging the closure 130 which is sufficiently able to withstand retort pressures and affects. Other sealing means can be provided, such as a foil seal secured by a suitable method.

A flexing portion 112 is formed about the side wall 104. As illustrated, the flexing portion 112 has a top interface with the side wall 104 at a top horizontal line 170 and a bottom interface with the side wall 104 at a bottom horizontal line 172. In a preferred embodiment, the flexing portion 112 comprises a number of ribs 114 formed about a circumference of the side wall 104. The ribs 114 are at least partially aligned in a direction of a height or longitudinal axis of the plastic container 100. Alternatively, the ribs 114 can have a different alignment, such as, an alignment skewed to the direction of the height of the plastic container 100. (See FIG. 9).

Figure 6:
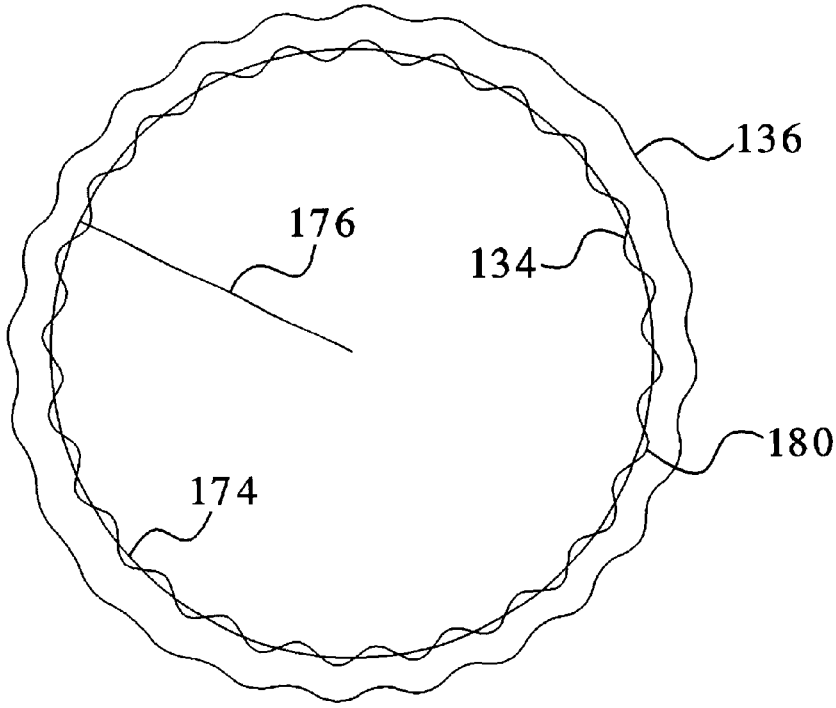
FIG. 6 is a cross-sectional view of the retortable plastic container of FIG. 1 in an original state prior to the retort process and in an expanded state during the retort process.

In a preferred embodiment, each rib 114 has an inner recessed or concave portion 120 and an outer boundary portion 122. The inner recessed portion 120 recesses from the outer boundary portion 120 toward an interior of the plastic container 100. Thus, the ribs 114 are generally rounded in cross section. The outer boundary portions 122 are themselves curvilinear in a direction toward the interior of the plastic container 100, therefore, a first length 178 along an outer boundary portion is greater than a straight line distance between the top and bottom horizontal lines 170 and 172. Thus, a mean circumference 174 (See FIG. 6) of the flexing portion 112 is less than a circumference of the side wall 104 at its interface to the flexing portion 112, for example less than the circumference of the side wall 104 at the top horizontal line 170 or bottom horizontal line 172. A radius corresponding to the mean circumference 174 of the flexing portion 112 is depicted in FIG. 6 as radius 176. And a second length 180 measured, in a horizontal plane, along the inwardly directed surface along the flexing portion 112, is greater than the mean circumference 174 of the flexing portion 112.

The outer boundary portions 122 of the ribs 114 can have a generally elliptical shape. Alternatively, the outer boundary portions 122 can have any other shape.

The flexing portion 114 is formed with a lesser thickness than a thickness of the remainder of the side wall 104. This provides greater flexibility relative to the remainder of the side wall 104. Accordingly, as will be described in greater detail below, during a retort process, the flexing portion 112 can flex in a direction of an exterior of the plastic container 100. The curvilinear geometry of the ribs 114 provides resilience for returning the flexing portion 112 to a merchantable shape after retort. In the context of this disclosure, unless otherwise qualified, the phrase "returning to a merchantable shape" means that the flexing portion 112 returns to its original shape, or substantially and sufficiently thereto, or to a shape that permits the plastic container 100 to be merchantable after retort. This is to ameliorate the difficulty in defining the return state. In addition, the curvilinear geometry of the ribs 114 provides an unexpected and advantageous grip for a user of the plastic container 100.

In an example, the plastic container 100 average wall thickness profile is as follows:

| Position | Average Thickness |
|---|---|
| Shoulder 106 | 0.039" |
| Flexing Portion 112 | 0.044" |
| Side Wall 104 | 0.055" |
| Bottom Portion 102 | 0.033" |

Figure 15:
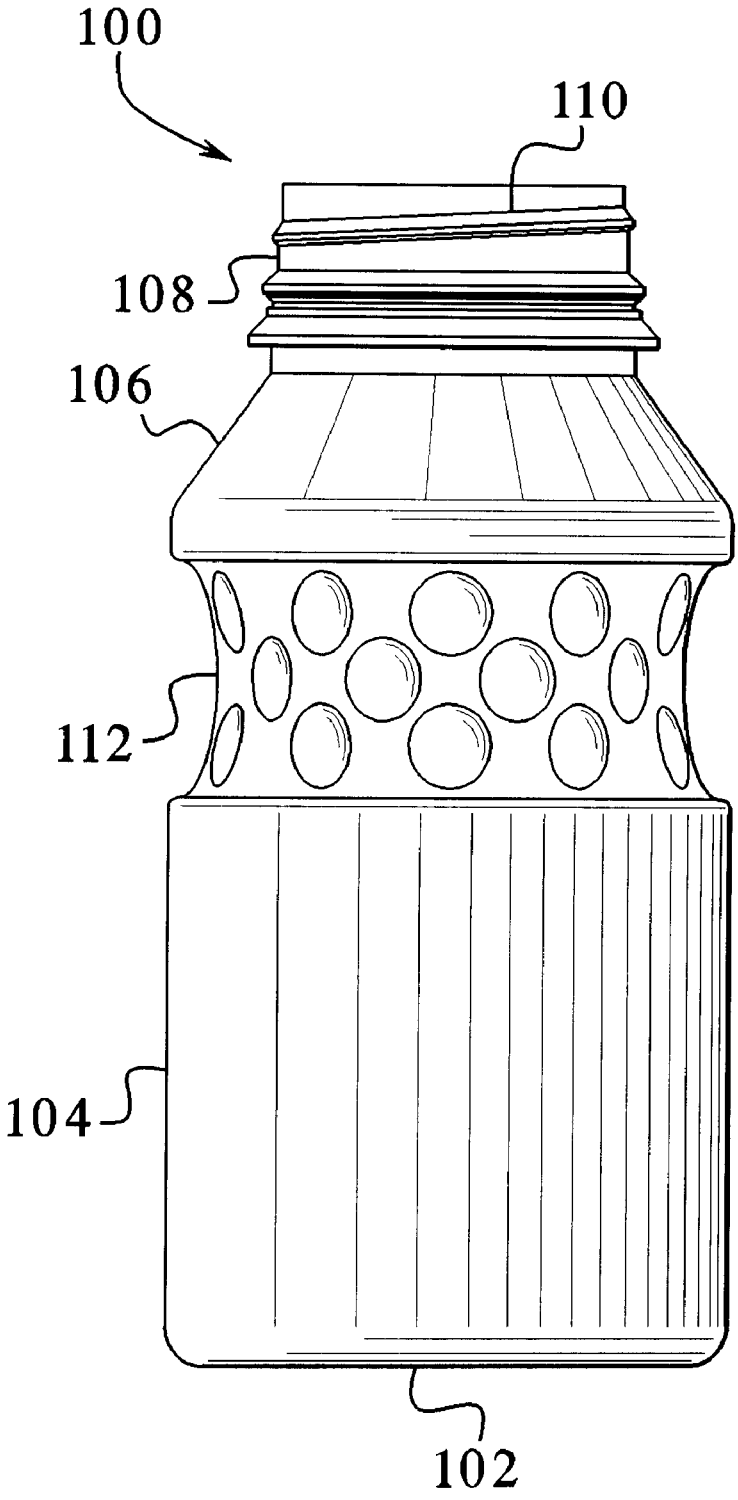
FIG. 15 illustrates a sixth retortable plastic container embodying principles of the present invention.
Figure 16:
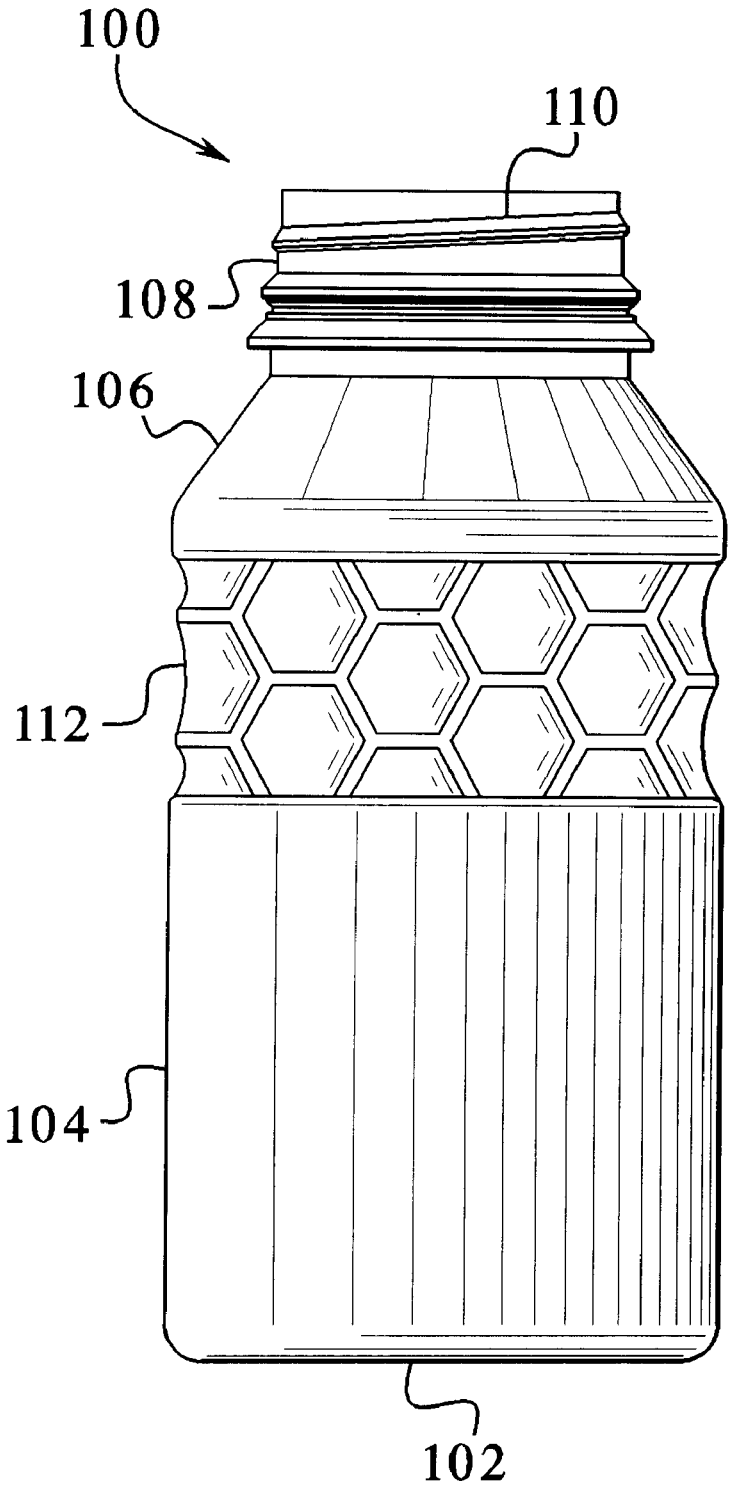
FIG. 16 illustrates a seventh retortable plastic container embodying principles of the present invention.

In alternative embodiments, the flexing portion 112 can comprise structures other than the above-described ribs 114, which structures are also suitable to provide adequate expansion of the plastic container 100 during retort. For example, in an embodiment, instead of ribs 114, the flexing portion 112 can comprise recessed hemispherical portions (See FIG. 15) patterned about a circumference of the flexing portion 112. In another embodiment, the flexing portion 112 can comprise an array of connected geometric shapes (See FIG. 16), such as hexagons, about the circumference of the flexing portion 112. A surface of the array of connected geometric shapes is generally curvilinear in a direction toward the interior of the plastic container 100.

Figure 2:
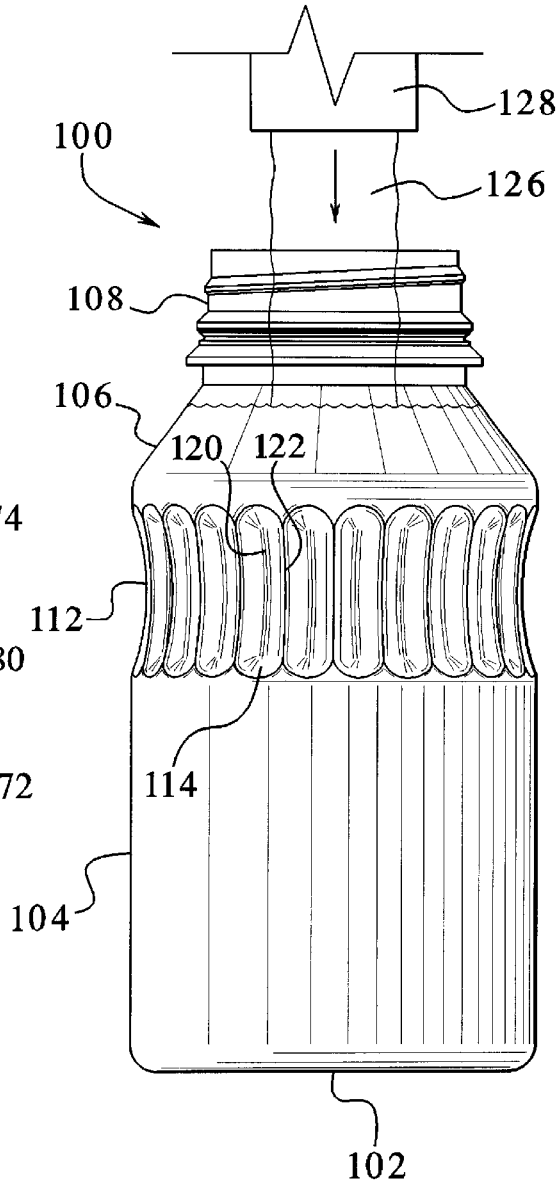
FIG. 2 is a front view of the retortable plastic container of FIG. 1 during a filling process.

In FIGS. 2 to 5 there is illustrated the plastic container 100 during processes for filling, retort, and then cooling. Referring to FIG. 2, an aqueous product 126, such as a comestible, is delivered from a filling device 128 into the open neck 108 of the plastic container 100.

Referring to FIG. 3, the closure 130 is then threaded to the neck 108 via the threads 110 to provide a seal. In the illustrated embodiment, the bottom portion 102 has a recessed center portion 132, formed, for example, by a bow. Up to this point, the plastic container 100 has maintained its original shape. The strengths of the side wall 104, the bottom portion 102, and the flexing portion 112 are substantial enough to resist the internal pressure on the plastic container 100 caused by the aqueous product 126 at room temperature.

Referring to FIG. 4, the plastic container 100 is then subjected to a retort process for sterilization. During the retort process, the plastic container 100 is heated in a pressurized vessel (not shown). The balance of pressure between the inside and outside of the plastic container 100 during retort is critical. It is preferred to keep the pressure outside the plastic container 100 a little less than it is on the inside of the plastic container 100. This tends to expand the plastic container 100, and counteracts its natural tendency to shrink. During retort, the external pressure on the plastic container 100 is directly controlled. However, the three variables that particularly determine the internal pressure of the plastic container 100, namely headspace volume, headspace temperature, and side wall flex, are not directly controlled during retort. Because plastic material of the plastic container 100 is softer and weaker at retort temperature, and because it is difficult to control the pressure differential merely by adjusting the external pressure, known plastic containers can experience catastrophic failure or unacceptable distortion when their construction fails to provide enough flexibility to relieve the pressure differential adequately.

The present plastic container 100 inventively overcomes this known disadvantage by providing the flexing portion 112 in the side wall 104 of the plastic container 100, which is a means for expansion of the plastic container 100. As a result of the flexing portion 112, the pressure inside the present plastic container 100 is allowed to rise a little, but not too much, over the pressure outside the plastic container 100. The internal pressure of the plastic container 100 forces the inwardly recessed ribs 114 to expand in an outward direction, and thereby to straighten. This also increases the height of the plastic container 100. In an extreme case, the ribs 114 can expand in an outward direction beyond the circumference of the side wall portion 104. Accordingly, the pressure differential between the inside and outside of the plastic container 100 is adequately relieved. The resultant relief of pressure differential permits the present plastic container 100 to experience retort conditions without occurrence of a catastrophic failure and to return to its merchantable shape.

Figure 14:
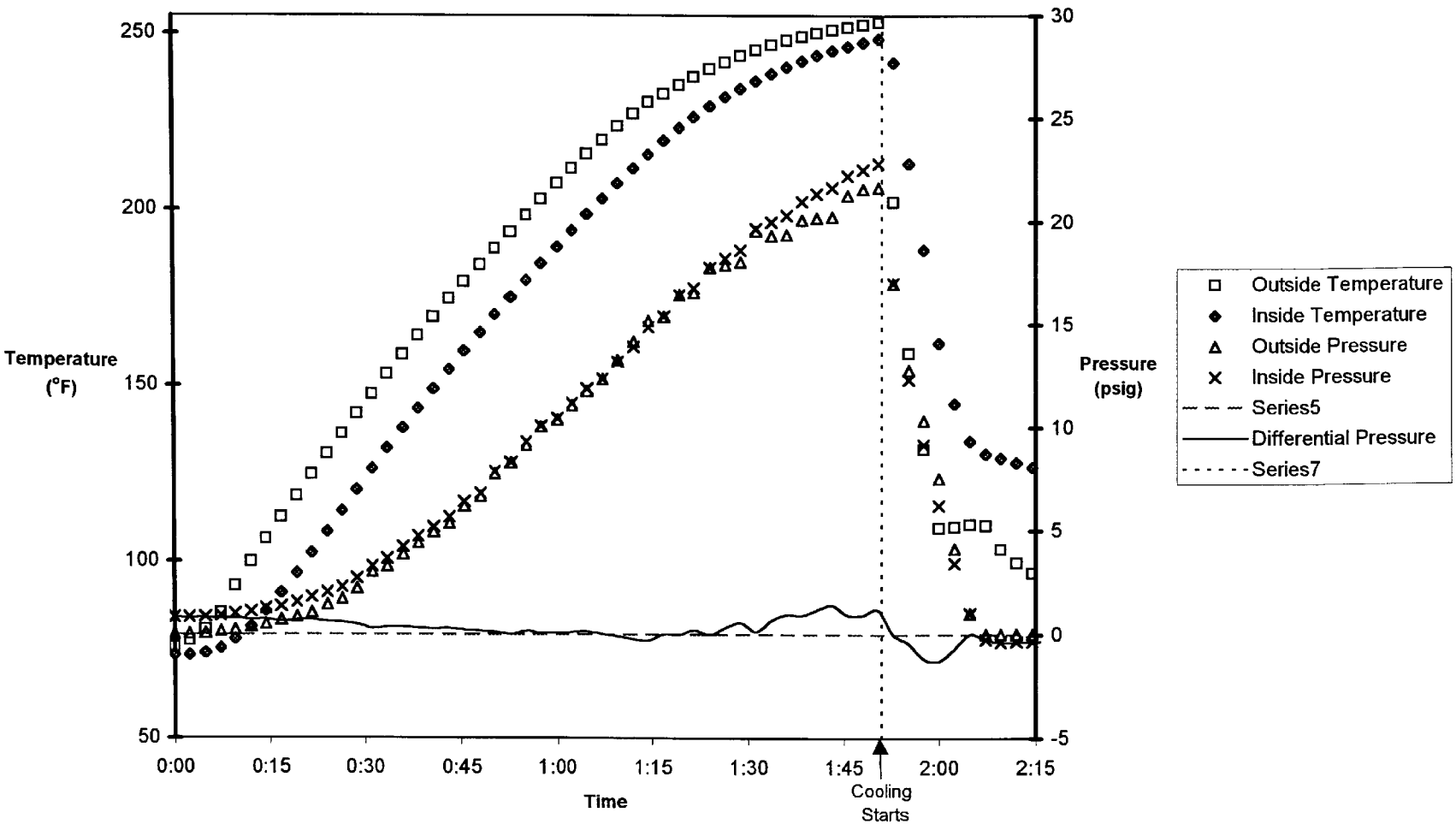
FIG. 14 is a graph illustrating the relationship between temperature and pressure inside and outside of the plastic container during a retort process.

FIG. 14 illustrates a relationship between temperature and pressure inside and outside of the plastic container during a sample retort process. In accordance with the present invention, as illustrated, the external pressure is maintained at a value slightly lower than that of the internal pressure throughout most of the retort process. While the outside pressure is controlled in an effort to maintain this pressure differential, the flexing portion 112 must also flex to maintain structural integrity of the plastic container 100 at the elevated retort temperatures.

During the retort process, very high overpressures may occur, wherein the pressure outside the plastic container 100 is greater than the pressure inside the plastic container 100 and, therefore, the plastic container 100 is compressed throughout. The flexing portion 112 accommodates the overpressure, thus adequately relieving the pressure differential between the inside and the outside of the plastic container 100 and permitting the plastic container to return to its merchantable shape.

After the retort process, the plastic container 100 cools to room temperature and the ribs 114 return to an inwardly recessed geometry such that the plastic container 100 has a merchantable shape. Thus, the present plastic container 100 can undergo a retort process and cool down process and yet maintain a merchantable shape.

FIG. 6 illustrates a cross-sectional view of the flexing portion 112 in a pre-retort original state 134 and an expanded state 136. In the original state 134, the plastic container 100 is, for example, at room temperature awaiting the retort process. During the retort process, the internal pressure of the plastic container 100 forces the ribs 114 to temporarily expand outwardly, thereby increasing the circumference of the flexing portion 112 to the expanded state 136.

Figure 7:
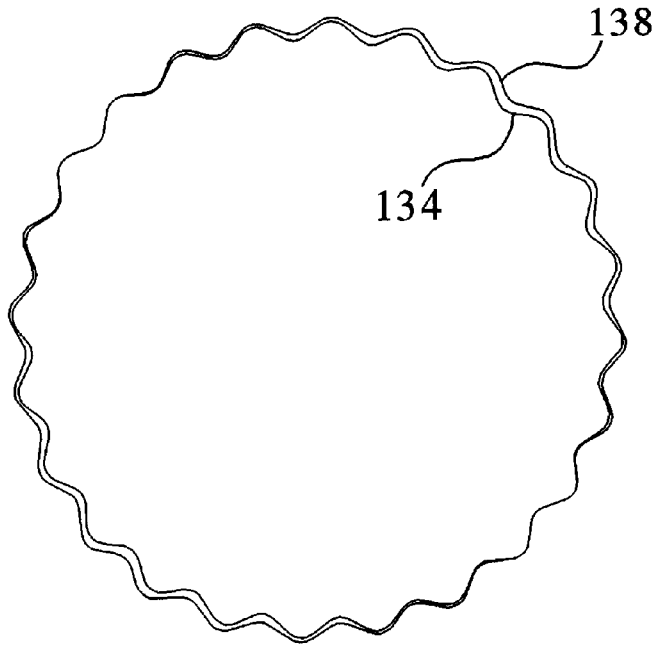
FIG. 7 is a cross-sectional view of the retortable plastic container of FIG. 1 in the original state prior to the retort process and in a return state after being returned to room temperature.

FIG. 7 illustrates a cross-sectional view of the flexing portion in the original state 134 and in a return state 138. Over time, the plastic container 100 returns to room temperature with the circumference of the flexing portion 112 returning to a return state 138. In the return state 138, the flexing portion 112 returns to a merchantable shape. As illustrated, the return shape at the return state 138 is preferably very close to the original shape at the original state 134.

As illustrated in FIG. 4, the recessed portion 132 of the bottom portion 102 of the plastic container 100 can also expand outwardly during the retort process. This expansion provides further flexibility to relieve the differential pressure, however, such expansion of the recessed portion 132, if incorporated, is not required under the present invention because the flexing portion 112 provides sufficient flexing for the plastic container 100 to return to a merchantable shape.

The geometry and thicknesses of the ribs 114 of the flexing portion 112 affect the amount that the flexing portion 112 will resiliently flex in the direction of the exterior of the plastic container 100 during retort. Ribs 114 that are more inwardly recessed in their original state 134 can provide greater plastic container 100 height expansion during retort. The dimensions of the plastic container 100 itself will also determine how it performs during retort. Larger containers, with greater headspace, will require a proportional flexing portion 102 having a longitudinal height and flexibility that effectively accommodates the increased internally generated pressure.

FIG. 5 illustrates the plastic bottle 100 after it has returned to room temperature. As shown, the flexing portion 112 has returned to the return state 138. Further, the recessed portion 132 of the bottom portion 102 has also returned to a merchantable shape.

Thus, the present invention provides a plastic container 100 that can withstand retort conditions and return to a merchantable shape. The flexing portion 112 inventively expands the plastic container 100 to relieve greater pressure differential than known devices.

Figure 8:
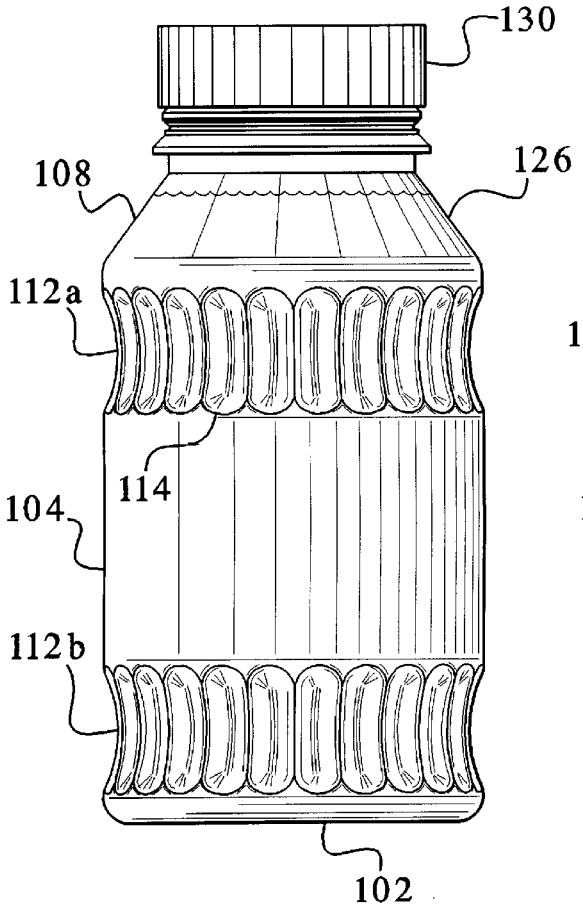
FIG. 8 is another retortable plastic container embodying principles of the present invention.
Figure 9:
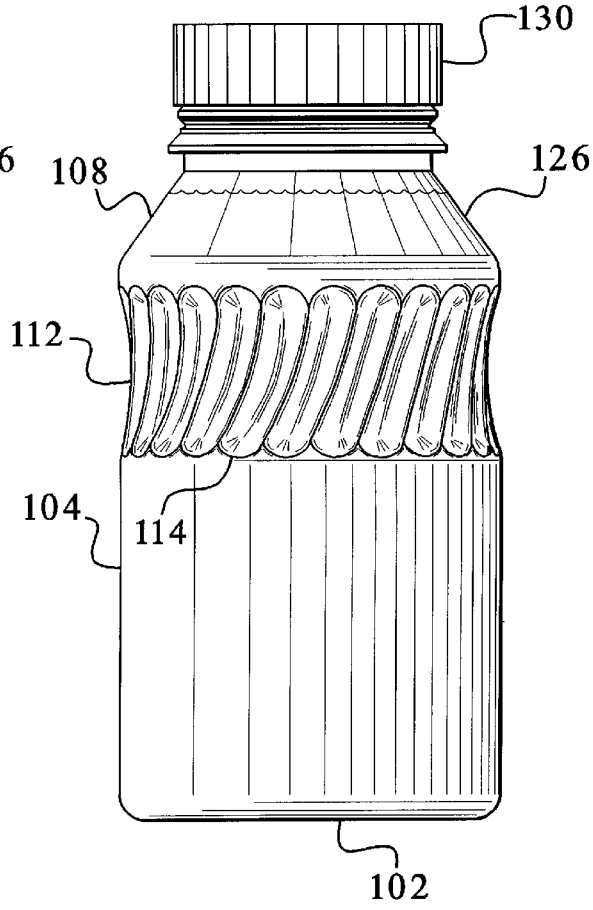
FIG. 9 illustrates a third retortable plastic container embodying principles of the present invention.

As illustrated in FIGS. 8 and 9, the flexing portion 112 can have other configurations. For example, as illustrated in FIG. 8, the flexing portion 112 can comprise two or more flexing portions 112*a* and 112*b*. Alternatively, the ribs 114 of the flexing portion 112 can be aligned in a direction other than in a direction of the height of the container. For example, as illustrated in FIG. 9, the ribs 114 of the flexing portion can be aligned in a direction which is skewed relative to the height of the container.

Figure 12:
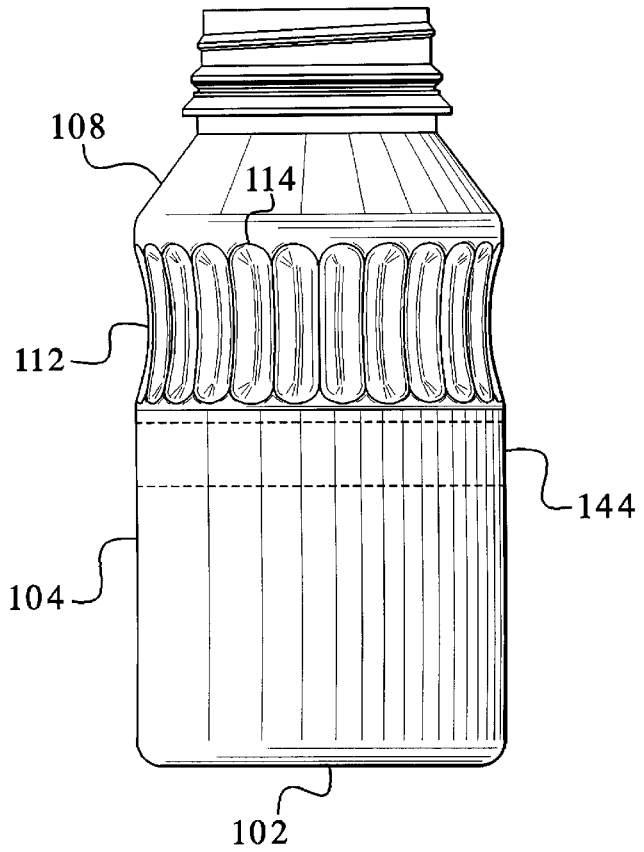
FIG. 12 illustrates a fourth retortable plastic container embodying principles of the present invention.

Referring to FIG. 12, to strengthen the side wall 104, in an embodiment, a thickened portion 144 is provided below the flexing portion 112 and has a thickness greater than a thickness of the side wall 104 adjacent thereto. In another embodiment, the side wall 104 is provided with a plurality of thickened portions 144. The thickness of the thickened portion 144 is achieved through parison profiling.

Figure 13:
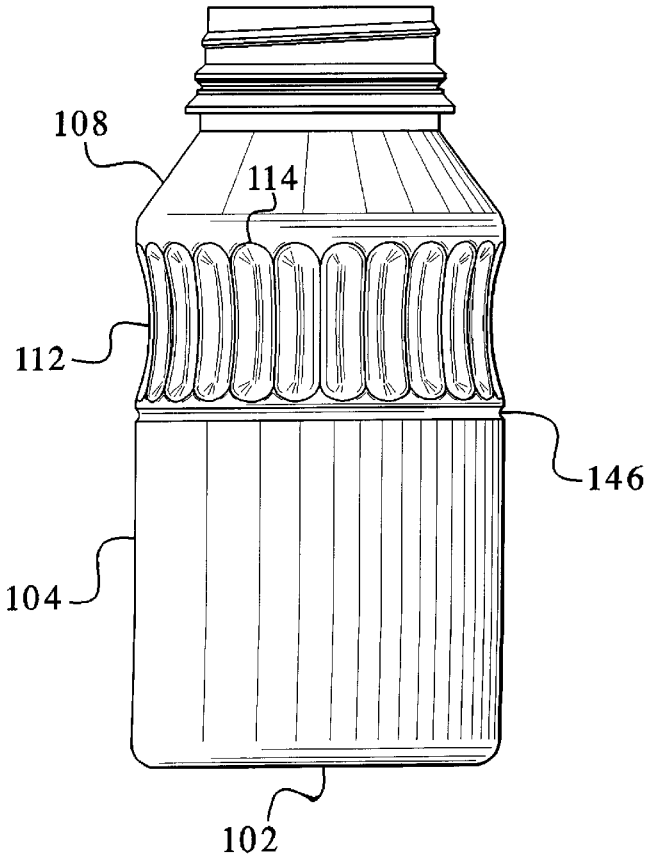
FIG. 13 illustrates a fifth retortable plastic container embodying principles of the present invention.

Referring to FIG. 13, as another means to strengthen the side wall 104, in an embodiment, the side wall 104 has an inwardly depressed groove 146 formed therein and about a circumference of the side wall 104. Such a groove 146 is also referred to as a belt.

The side wall 104 is illustrated in the Figures as having a generally cylindrical shape, however, in other embodiments, the side wall 104 can have different shapes. For example, in an embodiment, at least a portion of the side wall 104 has a generally conical shape along the height of the container. In another embodiment, at least a portion of the side wall 104 has a curvilinear shape along the height of the container.

Further, a cross-section of the side wall 104 can have any desired shape, including, for example, a generally cylindrical, rectangular or triangular cross-sectional shape.

It is to be understood that the flexing portion 112 is a portion of the side wall 104, and therefore the flexing portion 112 can also embody shapes other than a generally cylindrical shape, such as, for example the shape identified above.

In an embodiment, the bottom portion 102 does not flex, as the flexing portion 112 provides sufficient flex to relieve differential pressure. The bottom portion 102 will unavoidably flex unless it is made sufficiently rigid.

Figure 10:
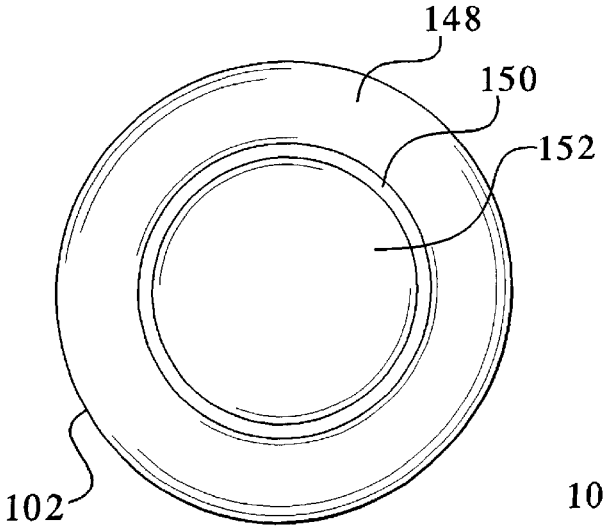
FIG. 10 is a bottom view of a first bottom portion usable in a retortable plastic container of the present invention.

Alternatively, the bottom portion 102 can comprise various other configurations to provide flexibility or stiffness. Referring to FIG. 10, he bottom portion 102 comprises, for example, a recessed portion 152. The recessed portion 152 can have any suitable configuration that permits resilient expansion. In the illustrated embodiment, the bottom portion has an outer bottom portion 148 which tapers 150 inwardly to a bottom recessed portion 152. During retort, the bottom recessed portion 152 can resiliently flex in a direction of an exterior of the plastic container 100. The taper 150 provides further resilience to return the bottom recessed portion 152 to a merchantable shape after the plastic container 100 returns to room temperature. Bottom portions of this type are discussed in U.S. Pat. Nos. 5,217,737; 5,234,126; and 5,269,437.

Figure 11:
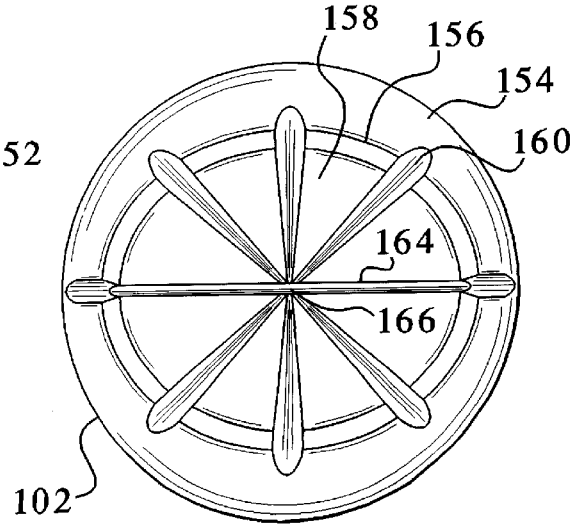
FIG. 11 is a bottom view of another bottom portion usable in a retortable plastic container of the present invention.

In another embodiment, the plastic container 100 has what is referred to as an Aspen bottom. The Aspen bottom has a reinforced bottom portion that resists outward bulging due to internally generated container pressure. Accordingly, a plastic container having an Aspen bottom can withstand transport through high elevations and the external pressure decrease that arises at high elevations. Referring to FIG. 11, the bottom portion 102 comprises an outer bottom portion 154 which tapers 156 to an elliptical bottom recessed portion 158. Inwardly depressed bottom grooves 160 radiate outward from a center 166 of the bottom portion 102 toward the side wall 104. The bottom grooves 160 expand in width until they are generally adjacent the outer bottom portion 154, at which point they generally reduce in width. An axial rib 164 extends across the bottom portion 102 and forms a reinforcement for the bottom recessed portion 158 to prevent outward expansion. Accordingly, this embodiment strengthens the bottom portion 102 to reinforce against pressures generated within the plastic container 100 during retort.

The plastic container 100 can comprise any material that is suitable for its application. In an embodiment, the plastic container 100 comprises polypropylene. Alternatively, the plastic container 100 can comprise, for example, a multilayered polypropylene.

The foregoing provides a retortable plastic container that has a minimum weight and that has a flexibility to substantially return to its original shape after being subjected to a retort process.

As is apparent from the foregoing specification, the present invention is susceptible to being embodied with various alterations and modifications which may differ particularly from those that have been described in the preceding specification and description. It should be understood that it is desired to embody within the scope of the patent warranted herein all such modifications as reasonably and properly come within the scope of the presently defined contribution to the art.

We claim as our invention:

1. A retortable plastic container, comprising:

a side wall having at least one flexing portion extending from a top horizontal line around a circumference of the side wall to a bottom horizontal line around the circumference of the side wall, the flexing portion having an inwardly directed surface relative to the circumference of the side wall, the inwardly directed surface having:

a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

2. The retortable plastic container of claim 1, wherein the flexing includes a plurality of inwardly recessed indentations.

3. The retortable plastic container of claim 1, wherein the flexing portion includes a plurality of ribs.

4. The retortable plastic container of claim 1, wherein the flexing portion includes a plurality of inwardly recessed dimples.

5. The retortable plastic container of claim 1, wherein the flexing portion includes an array of connected geometric shapes.

6. The retortable plastic container of claim 3, wherein the ribs are at least partially aligned in a direction of a height of the plastic container.

7. The retortable plastic container of claim 3, wherein each of the ribs include a recessed portion being recessed toward an interior of the plastic container.

8. The retortable plastic container of claim 3, wherein each of the ribs are substantially aligned in the direction of the height of the plastic container.

9. The retortable plastic container of claim 3, wherein each of the ribs are aligned in a direction skewed to the direction of the height of the plastic container.

10. The retortable plastic container of claim 7, wherein the recessed portion resiliently flexes in a direction of an exterior of the container during retort.

11. The retortable plastic container of claim 1, wherein the side wall further has a plurality of flexing portions each at a different position along the height of the plastic container.

12. The retortable plastic container of claim 1, further comprising a bottom portion.

13. The retortable plastic container of claim 12, wherein at least a region of the bottom portion resiliently flexes in a direction of an exterior of the plastic container during retort.

14. The retortable plastic container of claim 1, wherein the side wall has a thickened portion proximate the flexing portion, the thickened portion having a thickness greater than a thickness of regions of the side wall adjacent the thickened portion.

15. The retortable plastic container of claim 1, wherein the side wall has an inwardly depressed groove formed therein about at least a part of the circumference of the side wall.

16. The retortable plastic container of claim 1, wherein the plastic container comprises polypropylene.

17. The retortable plastic container of claim 1, wherein the plastic container comprises multi-layered polypropylene.

18. The retortable plastic container of claim 1, wherein the plastic container is used with an aqueous product.

19. The retortable plastic container of claim 1, wherein the plastic container is used with a comestible.

20. A retortable plastic container, comprising:

first and second longitudinal ends;

a wall extending between the ends and surrounding a longitudinal axis; and flexible wall members positioned about a circumference of the wall, a portion of the wall comprising the flexible wall members having an inwardly directed surface, the flexible wall members being concavities in the wall and being effective to flex toward an exterior of the plastic container during retort in response to increased internal plastic container pressure and to return to a merchantable shape upon cessation of retort in response to decreased internal plastic container pressure.

21. A method of forming a retortable plastic container, the method comprising:

forming a side wall having at least one flexing portion extending from a top horizontal line around a circumference of the side wall to a bottom horizontal line around the circumference of the side wall, the flexing portion having an inwardly directed surface relative to the circumference of the side wall, the inwardly directed surface having:

a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

22. The method of claim 21, wherein the flexing portion is formed to include a plurality of inwardly recessed indentations.

23. The method of claim 21, wherein the flexing portion is formed to include a plurality of ribs.

24. The method of claim 21, wherein the flexing portion is formed to include a plurality of inwardly recessed dimples.

25. The method of claim 21, wherein the flexing portion is formed to include an array of connected geometric shapes.

26. The method of claim 23, wherein each of the ribs comprises a recessed portion being recessed toward an interior of the plastic container.

27. The method of claim 23, wherein each of the ribs are substantially aligned in the direction of the height of the container.

28. The method of claim 23, wherein each of the ribs are aligned in a direction skewed to the direction of the height of the container.

29. The method of claim 26, wherein the recessed portion resiliently flexes in a direction of an exterior of the container during retort.

30. The method of claim 21, wherein the side wall is formed with a plurality of flexing portions each at a different position along the height of the plastic container.

31. The method of claim 21, further comprising:

forming a bottom portion of the plastic container.

32. The method of claim 31, wherein at least a region of the bottom portion resiliently flexes in a direction of an exterior of the container during retort.

33. The method of claim 21, wherein the side wall is formed with a thickened portion proximate the flexing portion, the thickened portion having a thickness greater than a thickness of regions of the side wall adjacent the thickened portion.

34. The method of claim 21, wherein the side wall is formed with an inwardly depressed groove therein about at least a part of the circumference of the side wall.

35. The method of claim 21, wherein the plastic container comprises polypropylene.

36. The method of claim 21, wherein the plastic container comprises multi-layered polypropylene.

37. The method of claim 21, wherein the plastic container is used with an aqueous product.

38. The method of claim 21, wherein the plastic container is used with a comestible.

39. A method of reducing differential pressure on a plastic container during retort, the method comprising:

providing a side wall of the plastic container, the side wall having at least one flexing portion extending from a top horizontal line around a circumference of the side wall to a bottom horizontal line around the circumference of the side wall, the flexing portion having an inwardly directed surface relative to the circumference of the side wall, the inwardly directed surface having:

a first length measured along the inwardly directed surface, in a central vertical plane from the top horizontal line to the bottom horizontal line, which is greater than a straight line distance between the top and bottom horizontal lines in the same vertical plane, and a second length measured along the inwardly directed surface along a perimeter of the flexing portion, in a horizontal plane, which is greater than a circumference of a circle having a radius of an average distance from a central vertical axis of the container to the inwardly directed surface, the circumference of the circle being in the horizontal plane.

* * * * *